US009100997B2

(12) United States Patent
Endres et al.

(10) Patent No.: US 9,100,997 B2
(45) Date of Patent: Aug. 4, 2015

(54) METHOD FOR TRANSMITTING CONTROL INFORMATION FROM A CONTROL APPARATUS TO AN OPERATING DEVICE FOR AT LEAST ONE LIGHT-EMITTING MEANS AND OPERATING DEVICE FOR AT LEAST ONE LIGHT-EMITTING MEANS

(71) Applicant: OSRAM GmbH, Munich (DE)

(72) Inventors: Helmut Endres, Zusmarshausen (DE); Klaus Fischer, Friedberg (DE); Josef Kreittmayr, Bobingen (DE)

(73) Assignee: OSRAM GmbH, Munich (DE)

( * ) Notice: Subject to any disclaimer, the term of this patent is extended or adjusted under 35 U.S.C. 154(b) by 54 days.

(21) Appl. No.: 13/771,196

(22) Filed: Feb. 20, 2013

(65) Prior Publication Data

US 2013/0214692 A1 Aug. 22, 2013

(30) Foreign Application Priority Data

Feb. 21, 2012 (DE) ..... 10 2012 202 595

(51) Int. Cl.
*G05F 1/00* (2006.01)
*H05B 37/02* (2006.01)

(52) U.S. Cl.
CPC ..... *H05B 37/02* (2013.01); *H05B 37/0263* (2013.01)

(58) Field of Classification Search
CPC ..... H05B 37/02
USPC ..... 315/200 R
See application file for complete search history.

(56) References Cited

U.S. PATENT DOCUMENTS

| | | | | |
|---|---|---|---|---|
| 6,043,611 | A * | 3/2000 | Gradzki et al. | 315/194 |
| 6,734,641 | B2 * | 5/2004 | Shoji et al. | 315/291 |
| 7,141,939 | B2 * | 11/2006 | Nagasawa et al. | 315/291 |
| 7,911,154 | B2 * | 3/2011 | Fischer et al. | 315/291 |
| 8,104,190 | B2 * | 1/2012 | Magill | 34/282 |
| 8,217,589 | B2 * | 7/2012 | Endres et al. | 315/306 |
| 8,552,659 | B2 * | 10/2013 | Ashdown et al. | 315/291 |
| 8,618,751 | B2 * | 12/2013 | Ostrovsky et al. | 315/362 |
| 8,624,523 | B2 * | 1/2014 | Briggs | 315/291 |
| 8,626,318 | B2 * | 1/2014 | Wu | 700/11 |
| 8,638,044 | B2 * | 1/2014 | Briggs | 315/291 |
| 8,674,616 | B2 * | 3/2014 | Holman et al. | 315/224 |
| 8,702,435 | B2 * | 4/2014 | Tajima | 439/140 |
| 2014/0035481 | A1 * | 2/2014 | Peting et al. | 315/291 |

FOREIGN PATENT DOCUMENTS

| | | | |
|---|---|---|---|
| DE | 102009051968 | A1 | 5/2011 |
| WO | 9966655 | A1 | 12/1999 |
| WO | 2009156952 | A1 | 12/2009 |

* cited by examiner

*Primary Examiner* — Douglas W Owens
*Assistant Examiner* — Srinivas Sathiraju

(57) ABSTRACT

A method for transmitting control information from a control apparatus to an operating device for a light-emitting means may include a) modulating control information onto a supply line by means of the control apparatus during a modulation phase, wherein a switchable shunt of the device is connected between the first and second supply connections; b) decoding the control information in a decoder of the device; b1) activating the demodulation by the decoder when the absolute value for the voltage at the two supply connections falls below a first threshold value; and c) actuating a converter of the operating device in accordance with the decoded control information.

16 Claims, 4 Drawing Sheets

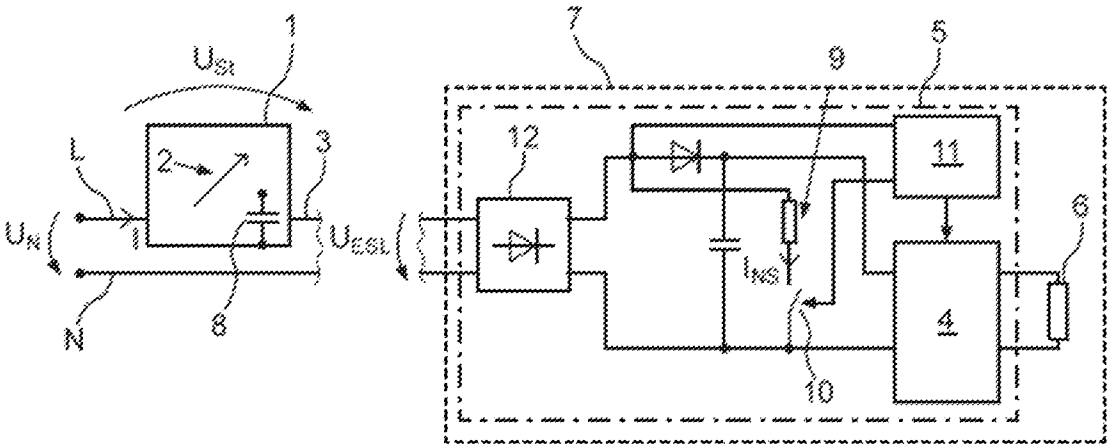
Fig. 1(SdT)
PRIOR ART

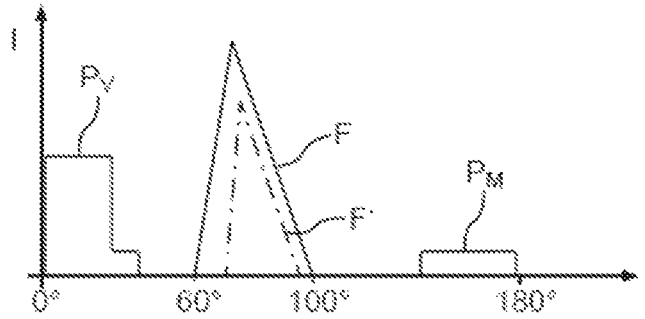
Fig.2a(SdT)
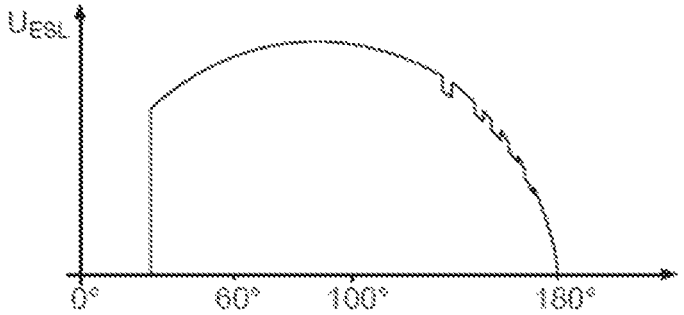
Fig.2b(SdT)
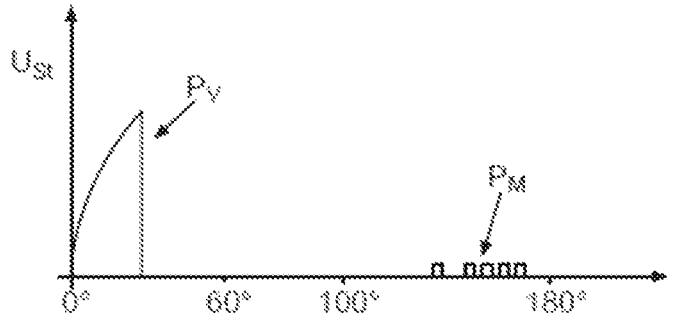
Fig.2c(SdT)
PRIOR ART

METHOD FOR TRANSMITTING CONTROL INFORMATION FROM A CONTROL APPARATUS TO AN OPERATING DEVICE FOR AT LEAST ONE LIGHT-EMITTING MEANS AND OPERATING DEVICE FOR AT LEAST ONE LIGHT-EMITTING MEANS

RELATED APPLICATIONS

The present application claims priority from German application No.: 10 2012 202 595.2 filed on Feb. 21, 2012.

TECHNICAL FIELD

Various embodiments relate to a method for transmitting control information from a control apparatus to an operating device for at least one light-emitting means, wherein the operating device has a first and a second supply connection, wherein the control apparatus has an input, which is coupled to the phase conductor of an AC voltage system, wherein the first supply connection is coupled to an output of the control apparatus via a supply line, wherein the second supply connection is coupled to the neutral conductor of an AC voltage system, including the following steps: a) modulating the control information onto the supply line by means of the control apparatus during a modulation phase, wherein, at least during the modulation phase, a switchable shunt of the operating device is connected between the first and second supply connections; b) decoding the control information in a decoder of the operating device; and c) actuating a converter of the operating device in accordance with the decoded control information. Moreover, various embodiments relate to a corresponding operating device for at least one light-emitting means.

BACKGROUND

Such a method and such an operating device are known from DE 10 2009 051 968 A1. The appended FIGS. 1 and 2*a*, 2*b* and 2*c* originate from this application and serve to explain the problem on which the present invention is based. In accordance with the circuit arrangement shown in FIG. 1, a lighting system comprises a control apparatus 1 with an operating element 2, which can be in the form of a pushbutton or a rotary button. The control apparatus 1 is connected on the input side to a phase L of an AC voltage system $U_{Sys.}$, for example to the power supply system conventional in Europe with an AC rms voltage of 230 V. On the output side, the control apparatus 1 is connected to an operating device 5 via a supply line 3, wherein the operating device 5 is additionally connected on the input side to the neutral conductor N of the AC voltage system $U_{Sys.}$. A direct connection of the control apparatus 1 to the neutral conductor N is not provided. The operating device 5 is used for operating a light-emitting means 6. The light-emitting means 6 may be a fluorescent lamp, for example. By way of example, the operating device 5 can also be integrated in a lamp, as is the case for an energy saving lamp (ESL). A converter 4 converts electrical energy from the AC voltage system $U_{Sys.}$ into a form for operating the light-emitting means 6. The converter 4 as part of the operating device 5 comprises the necessary equipment for operating said operating device. The operating device 5 and the light-emitting means 6 in the present example form an energy saving lamp, with the voltage $U_{ESL}$ being present at the input of said energy saving lamp. The operation of other light-emitting means 6 by means of such an operating device 5 is likewise possible.

By setting the operating element 2 of the control apparatus 1 it is possible, for example by rotating a rotary knob or actuating a pushbutton, to input control information which is converted by the control apparatus 1 into modulation which is transmitted with the supply voltage transmitted by the supply line 3 to the operating device 5. The modulation is decoded on the lamp side by a decoder 11 associated with the operating device 5 and is used for actuating the light-emitting means 6 via the converter 4. For this purpose, the control apparatus 1 and the operating device 5 have corresponding signal processing units, for example microprocessors.

One or more further operating devices can be connected to the control apparatus 1, in parallel with the operating device 5. These parallel-connected operating devices are then operated via the control apparatus 1, which is connected upstream of said operating devices.

The control apparatus 1 comprises a modulator (not illustrated in the figures) for modulating control information to specific components of the half-cycles of the AC voltage system $U_{Sys.}$ which are conducted to the operating device 5. The control information itself is set via the operating element 2, as has already been explained briefly above. This control information may be, for example, brightness information and/or another operational setting of the operating device 5, in particular of the light-emitting means 6 associated with the operating device 5.

The operating device 5 comprises a shunt 9, which can be activated via a switch 10. The decoder associated with the operating device 5 for decoding the transmitted control information is characterized by the reference symbol 11. On the input side, the operating device 5 has a full-bridge rectifier 12, which is connected to the supply line 3 and the neutral conductor N. The decoder 11 applies the decoded control information to the converter 4 operating the light-emitting means 6. The decoder 11 likewise actuates the switch 10. The operating device 5 can comprise further circuits which may be necessary for operating the light-emitting means 6, for example for current limitation or for generating a relatively high frequency, which are generally implemented in an integrated converter 4 of a compact fluorescent lamp.

Furthermore, a capacitor 8 (illustrated only symbolically in terms of circuitry) is associated, as energy store, with the control apparatus 1 and is used to supply operating voltage to the control apparatus 1, as explained below. If the control apparatus 1 draws its operating current via the shunt of the operating device 5, the capacitor 8 is charged. The operating energy output of the energy store takes place in those operating states of the lighting system in which the control apparatus 1 is not drawing any energy via the shunt 9 of the operating device 5.

The positive and negative components of the AC voltage present across the phase conductor L and the neutral conductor N are rectified by the rectifier 12, with the result that two positive half-cycles are provided at the output of the rectifier 12 within an AC voltage period.

The term "modulation phase" $P_M$ used in the context of the following embodiments should be understood to mean that part of a half-cycle in which information is impressed on the AC voltage supplied to the operating device 5.

The term "supply phase" $P_S$ used in the context of these embodiments is intended to mean that part of a half-cycle in which the control apparatus 1 can be supplied with energy via a supply line between the control apparatus 1 and the operating device.

The term "shunt phase" used in the context of these embodiments is intended to mean those parts of a half-cycle in which the shunt 9 is activated by virtue of the switch 10 being switched on.

The term "operating phase" used in the context of these embodiments is intended to mean those parts of a half-cycle in which the operating device 5 draws energy for light generation.

This said, FIG. 2*a* shows, using the example of an energy saving lamp as light-emitting means, that the operating device draws its operating energy in an interval of between approximately 60 degrees and approximately 100 degrees of each half-cycle. The curve of the operating current consumption is illustrated by the reference symbol F, to be precise in the case of operation of the light-emitting means 6 on full power. The dashed curve F' describes the operating current consumption in the dimmed state.

The modulation phase $P_M$ is illustrated schematically in the latter part of the half-cycle. The supply phase $P_S$ is located in the first part of the half-cycle, for example at a phase angle of between 0 degrees and less than 40 degrees. In the method illustrated, this is stepped, with a first and a second part, wherein a higher shunt current flows in the first part of the supply phase $P_S$ than in the subsequent, relatively short second part of the supply phase.

As a result of the series circuit comprising the control apparatus 1 and the operating device 5, when the shunt switch 10 is closed the control apparatus 1 can draw operating energy itself and can charge its energy store (capacitor 8). If, on the other hand, the shunt switch 10 is open, the control apparatus 1 cannot draw any power from the AC voltage applied. In order nevertheless to supply the required energy to the control apparatus 1 when the switch 10 is open, the capacitor 8 is provided, said capacitor feeding energy to the control apparatus 1 in these phases. The following half-cycles (not illustrated in FIG. 2*a*) likewise have the abovementioned phases since the control information to be transmitted, the so-called telegram, has generally been divided into a plurality of successive half-cycles. In addition, in the exemplary embodiment illustrated, the control information is transmitted cyclically and continuously.

FIG. 2*b* shows the profile of the voltage $U_{ESL}$ at the operating device 5. During the modulation phase $P_M$, the control information is modulated onto the AC voltage supplied to the operating device 5, to be precise with a largely constant modulation voltage. In the first part of the half-cycle, the supply phase $P_S$ can be identified, in which the control apparatus 1 acts in current-limiting fashion and therefore reduces the voltage across the operating device 5.

With reference to FIG. 2*a*, the first part of the supply phase is ended in time-controlled fashion. The second part ends in voltage-controlled fashion when the absolute value of the voltage between the supply connections of the operating device exceeds a predetermined voltage. In the first part of the supply phase $P_S$, for example, currents of approximately 150 to 400 mA can flow. This current is limited by the control apparatus 1 and is used for the energy supply to said control apparatus. In the second part of the supply phase, for example, currents of approximately 20 mA flow. This current is predetermined as the maximum shunt current of the operating device 5. The first part of the supply phase $P_S$ is used for charging the energy store 8 associated with the control apparatus 1.

In order to keep the power loss in the operating device 5 and the control apparatus 1 low and to ensure a defined voltage rise at the input of the operating device 5 once the supply phase $P_S$ is complete, the supply phase is ended in the second part so as to form an intermediate level, in this case approximately 20 mA. Once the supply phase $P_S$ has ended, the operating device 5 draws the energy required for its operation in the operating phase. If this is concluded, the modulation phase $P_M$ of this half-cycle is implemented, to be precise when the shunt switch 10 is closed, wherein this shunt can in turn be at the lower level of the supply phase $P_S$ implemented prior to the operating energy consumption.

FIG. 2*c* shows the voltage profile during the above-described different phases of a half-cycle across the control apparatus 1. It can clearly be seen that, in the supply phase $P_S$, there is a greater voltage drop across the control apparatus 1 than during the other phases in the latter part of the half-cycle.

In the exemplary embodiment described, the operating element 2 serves to set the brightness of the light-emitting means 6 and therefore to dim said light-emitting means. The control information to be transmitted to the converter 4 is therefore a controlled variable corresponding to a perceivable brightness value as a sensory impression. A corresponding dimming curve can be stored in the control apparatus 1 or in the operating device 5.

The modulation takes place by superimposition of a square-wave modulation voltage with a constant level on the envelope of the supply voltage applied to the operating device 5. Therefore, high-pass filtering is performed in the decoder 11 in order to isolate the data signal from the AC voltage. The voltage level of the modulation is from 4 to 15 V, for example.

In the method disclosed in the mentioned DE 10 2009 051 968 A1, a shunt is produced prior to or at the beginning of the modulation of control information. The production of a shunt serves to provide defined potential conditions in the line used for the transmission of the control information. By virtue of such a shunt, the line used for transmitting the control information is terminated with a defined impedance determined by the parasitic effects of said line. Parasitic effects such as, for example, a capacitance or inductance per unit length of line or crosstalk between lines laid next to one another can disrupt the transmission of the control information. The impedance of the shunt is now selected such that interference to be expected is effectively suppressed. By virtue of this shunt, the control information modulated onto the AC voltage supplied to the light-emitting means can be received by the lamp unit without being subject to any interference and can be decoded. Preferably, provision is made for the control information to be modulated onto the supply voltage only in those phases of a half-cycle in which the actuated light-emitting means draws no or substantially no operating energy or no notable operating energy.

Preferably, the shunt phase in the abovementioned method is also used for supplying operating energy to the control apparatus. The supply to the control apparatus takes place, as has already been mentioned, outside of the modulation phase in a supply phase, wherein the shunt is likewise activated in the supply phase of the half-cycle.

In the case of control apparatuses with the two-wire technology illustrated in FIG. 1, the control apparatus can only be supplied with energy when the operating device permits a current flow. This takes place during the supply phase. However, the AC system should also be connected to the operating device at as low a resistance as possible by the control apparatus during the operating phase as well in order that safe operation of the light-emitting means is ensured. A withdrawal of energy by the control apparatus during the operating phase should therefore be avoided or restricted to times in which the operating device only draws a low current, in comparison with a current in the environs of the system voltage maximum.

Further details are given in the mentioned DE 10 2009 051 968 A1.

By way of summary, it can be stated that the shunt is connected at least during the modulation phase $P_M$, preferably also during the supply phase $P_S$.

The data transmission can primarily be disrupted during operation of such an arrangement comprising the control apparatus and the operating device, for example for the purposes of dimming, on a supply system with a relatively high impedance or by other electrical appliances being connected in parallel or in series. For example, very inductive or capacitive loads which are connected to the same supply system in parallel with such an arrangement can deform the voltage applied to the arrangement.

Even the described switching-on of the shunt at the beginning of the modulation phase $P_M$ can result in a temporary dip in the input voltage $U_{ESL}$ of the operating device 5 owing to this additional load.

Both of the abovementioned disruptive influences can result in voltage dips occurring at the input of the operating device during the modulation phase $P_M$ and being evaluated by the decoder 11 as data signal, although these have not been generated by the control apparatus itself for the purposes of data transmission.

As a result of the fact that the decoder is actively set to a defined start state at the beginning of the modulation phase, the influence of the above-described voltage dip, which is caused by the shunt being switched on, can be eliminated by virtue of the decoder actively being set to a defined state only once the shunt has been switched on. However, in this case there is still the problem that dips in the input voltage caused by external influences during the modulation phase can disrupt data transmission. This can take place both temporally prior to, during and after the actual data transmission.

SUMMARY

Various embodiments develop the method mentioned at the outset or the operating device mentioned at the outset in such a way that transmission of control information from the control apparatus to the operating device which is as reliable as possible is enabled.

Various embodiments are based on the knowledge that, in this case, no temporal synchronization of the start of the data transmission in the control apparatus, on the one hand, and of the activation of the data reception of the decoder of the operating device on the other hand takes place for system-related reasons. That is to say that the data transmission starts after a predeterminable time period after the last zero crossing of the AC voltage, while the decoder is activated in accordance with the teaching of the known DE 10 2009 051 968 A1 when the voltage $U_{ESL}$ at the two supply connections has fallen below a first predeterminable threshold value. To this extent, the decoder needs to be reception-ready for a markedly longer time than the data transmission itself requires. The time in which the decoder responds to voltage fluctuations and is therefore sensitive to external interference is therefore relatively long.

Even when voltage fluctuations caused by interference occur for only a very short period of time during the entire modulation phase, the actually transmitted data can no longer be correctly evaluated; the transmitted telegram needs to be discarded. Primarily in the case of the occurrence of periodic interference, this means that data transmission can no longer take place.

Various embodiments are based on the knowledge that a significant increase in the transmission reliability can be achieved when the decoder is blocked for a variable time, preferably starting from the beginning of the modulation phase, and is therefore insensitive to interference signals. Voltage fluctuations which occur as a result of interference in the time segment from the beginning of the modulation phase up to the beginning of the actual data transmission can thus be blanked out.

In the method according to the invention, therefore, provision is made, in a step b1), for first the demodulation to be activated by the decoder when the absolute value for the voltage at the two supply connections falls below a first predeterminable threshold value, wherein the demodulation is blocked, however, for a first predeterminable time period, once a second predeterminable time period has elapsed, once the absolute value of the voltage at the two supply connections has fallen below the first predeterminable threshold value when the decoder has not received any valid control information in the preceding half-cycle of the voltage at the two supply connections.

By virtue of this measure, it is largely possible to ensure that interference which temporally does not fall directly into the data transmission, i.e. into the transmission of the control information, is blanked out, as a result of which the transmission reliability of the system is markedly increased.

Preferably, the modulation of the control information begins after a predeterminable time period after the last zero crossing of the AC voltage. For this purpose, the zero crossings of the AC voltage are detected in the control apparatus and, after a third predeterminable time period, the modulation of the control information is then started.

Preferably, the voltage at the two supply connections is rectified, at least prior to step b), in particular prior to a comparison with the first predeterminable threshold value. This results in the advantage that the first predeterminable threshold value only needs to be provided once, i.e. only with one mathematical sign. Moreover, the comparison step is facilitated thereby.

Preferably, the following step b2) is implemented if, after step b1), valid control information has been received: retaining the first predeterminable time period; and the following step b3) if, after step b1), no valid control information has been received: extending the first predeterminable time period, in particular by a predeterminable duration or in accordance with a linear or nonlinear function.

By virtue of this measure, dynamic matching of the time period blocking the decoder to cyclically occurring interference can take place. In this way, first the first predeterminable time period can be selected to be short in order to then successively perform matching to the actually required time period. To this extent, preferably the following further steps are implemented: b4) if, after step b3), valid control information has been received: retaining the extended first predeterminable time period; or step b5), if, after step b3), no valid control information has been received: extending the first predeterminable time period, in particular by the predeterminable duration, and respectively checking for reception of valid control information; if valid control information has been received: retaining the present first predeterminable time period; if no valid control information has been received: extending the first predeterminable time period until a predeterminable maximum value for the first predeterminable time period is reached.

A predeterminable maximum value for the first predeterminable time period can be defined in that a further extension of the first predeterminable time period would result in an overlap with the time period for the transmission of the control information. Although this would possibly suppress an interference factor present, this would not result in the desired success when the actual data transmission is impaired by the blocking time period.

Preferably, therefore, the following step b6) is implemented, to be precise if still no valid control information has been received once the predeterminable maximum value for the first predeterminable time period has been reached: shortening, in particular stepwise or linearly, the first predeterminable time period and respectively checking for the reception of valid control information; or resetting the first predeterminable time period to the start value for the first predeterminable time period according to step b1).

Introducing a predeterminable maximum value for the first predeterminable time period takes into account the circumstance that, in the case of an additional extension of the first predeterminable time period, the decoder would be blocked for a time period which would safely fall into the time of the actual data transmission. This would mean that data transmission which is error-free per se would be ignored because the reception of valid data would be suppressed. The proposed measure makes it possible to ensure that the system is not unoperational for a comparatively long period of time.

Preferably, furthermore the following step b7) is implemented, to be precise if valid control information has been received in a half-cycle. In this case, demodulation for the rest of the half-cycle is blocked or voltage fluctuations at the input of the lamp unit are ignored by the decoder up to the following zero crossing of the voltage between the two supply connections. As a result, the risk of voltage fluctuations possibly being misinterpreted as data after the data transmission is largely ruled out, with the result that the decoder is ready for decoding the data transmitted with the next half-cycle.

In a preferred development, the following step b8) is implemented prior to implementation of step b1) or prior to implementation of step b3): counting the successive half-cycles in which no valid control information has been received; if the count exceeds a second predeterminable threshold value: implementing step b1) or implementing step b3). This measure makes it possible to reliably prevent an undesired extension of the blocking time period. In other words, blocking over the first predeterminable time period is not performed directly on the first occurrence of failed data transmission, but only once a predeterminable number of half-cycles with failed data transmission. In the mentioned second case, in any event the extension of the blocking time period is reset until a predeterminable number of half-cycles with failed data transmission has been established. In the event of failed data transmission, the transmitted telegram is nevertheless completely discarded, but owing to delayed activation of the decoder blocking it is possible to prevent blocking from being implemented or an increase in the first predeterminable time period from being implemented after the occurrence of one-off interference, with the result that there would be the risk of the blocking of the decoder itself preventing the reception of further data.

Preferably, in step b8), a count is continuously determined, in which a half-cycle in which valid control information has been received enters with a positive mathematical sign and a half-cycle in which no valid control information has been received enters with a negative mathematical sign. In this way, the number of half-cycles with failed data transmission which is stored in an error store can be reduced. Only if the count exceeds a third predeterminable threshold value is step b1) or step b3) implemented. Alternatively, the error store can be set suddenly to zero after the first error-free data transmission after failed transmissions. In the event of the occurrence of one-off interference, an excessive extension of the latency of the data transmission can be avoided with this configuration of the method.

The second predeterminable time period is preferably between zero and eight times the first predeterminable time period. In other words, the blocking can begin directly after the time at which the absolute value for the voltage at the two supply connections has fallen below the first predeterminable threshold value. However, the blocking can also only take place after a predeterminable delay.

The control information can comprise a multiplicity of half-cycles. Preferably, in this case each half-cycle of the multiplicity of half-cycles is evaluated in accordance with step b1). This results in particularly quick determination of the blocking time period to be selected for ensuring data transmission and therefore enables particularly reliable operation of the operating device.

Further preferred embodiments are given in the dependent claims.

The preferred embodiments set forth with reference to the method according to the invention and the advantages of said embodiments apply correspondingly, where applicable, to the operating device according to the invention.

BRIEF DESCRIPTION OF THE DRAWINGS

Embodiments of the present invention will now be described in more detail below with reference to the attached drawings, in which:

FIG. 1 shows a schematic illustration of a circuit arrangement known from the prior art which is suitable for implementing the method according to the invention;

FIGS. 2*a*) to 2*c*) show graphs known from the prior art illustrating the current and voltage profiles at the operating device and the control apparatus;

DETAILED DESCRIPTION

The following detailed description refers to the accompanying drawings that show, by way of illustration, specific details and embodiments in which the invention may be practiced.

The reference symbols introduced with reference to FIGS. 1 and 2 will continue to be used below for identical and functionally identical components.

Figure 3:
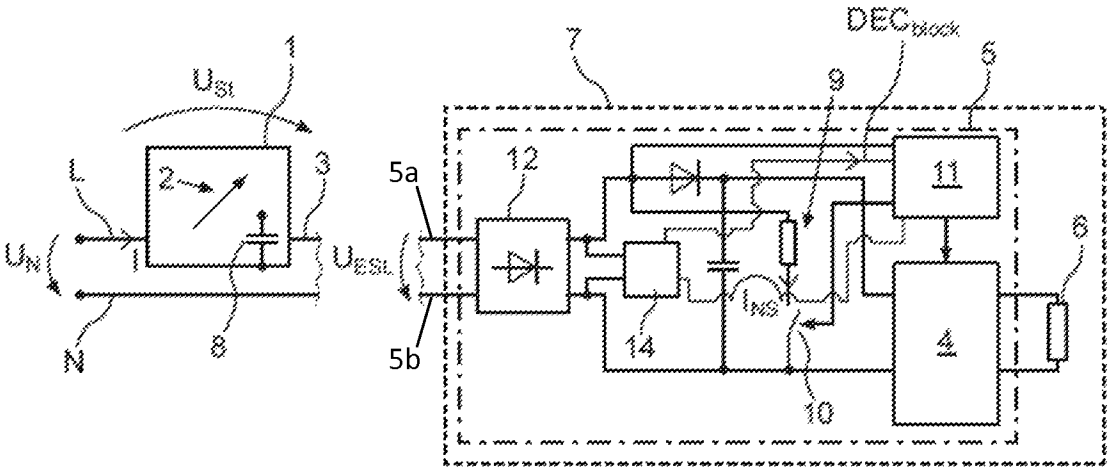
FIG. 3 shows a schematic illustration of a circuit arrangement with an operating device according to the invention, which is suitable for implementing the method according to the invention.

FIG. 3 shows a schematic illustration of an exemplary embodiment of a circuit arrangement of a lighting system with a control apparatus 1 and an operating device 5 according to the invention. The operating device 5 comprises a demodulation activation apparatus 14, which is coupled to the decoder 11, and wherein the operating device 5 has a first supply connection 5*a* and a second supply connection 5*b*.

The demodulation activation apparatus 14 is designed to activate the decoder 11 for demodulating the voltage $U_{ESL}$ when the absolute value for the voltage $U_{ESL}$ falls below a first predeterminable threshold value $U_{Th}$. The demodulation activation apparatus 14 is furthermore designed to block demodulation for a first predeterminable time period $t_b$, to be precise once a second predeterminable time period $t_s$ has elapsed once the absolute value for the voltage $U_{ESL}$ has fallen below the first predeterminable threshold value $U_{Th}$. However, this only takes place when the decoder 11 has not received any valid control information in the preceding half-cycle of the voltage $U_{ESL}$. The second predeterminable time period $t_s$ can be between zero and eight times the first predeterminable time period $t_b$.

Figure 4:
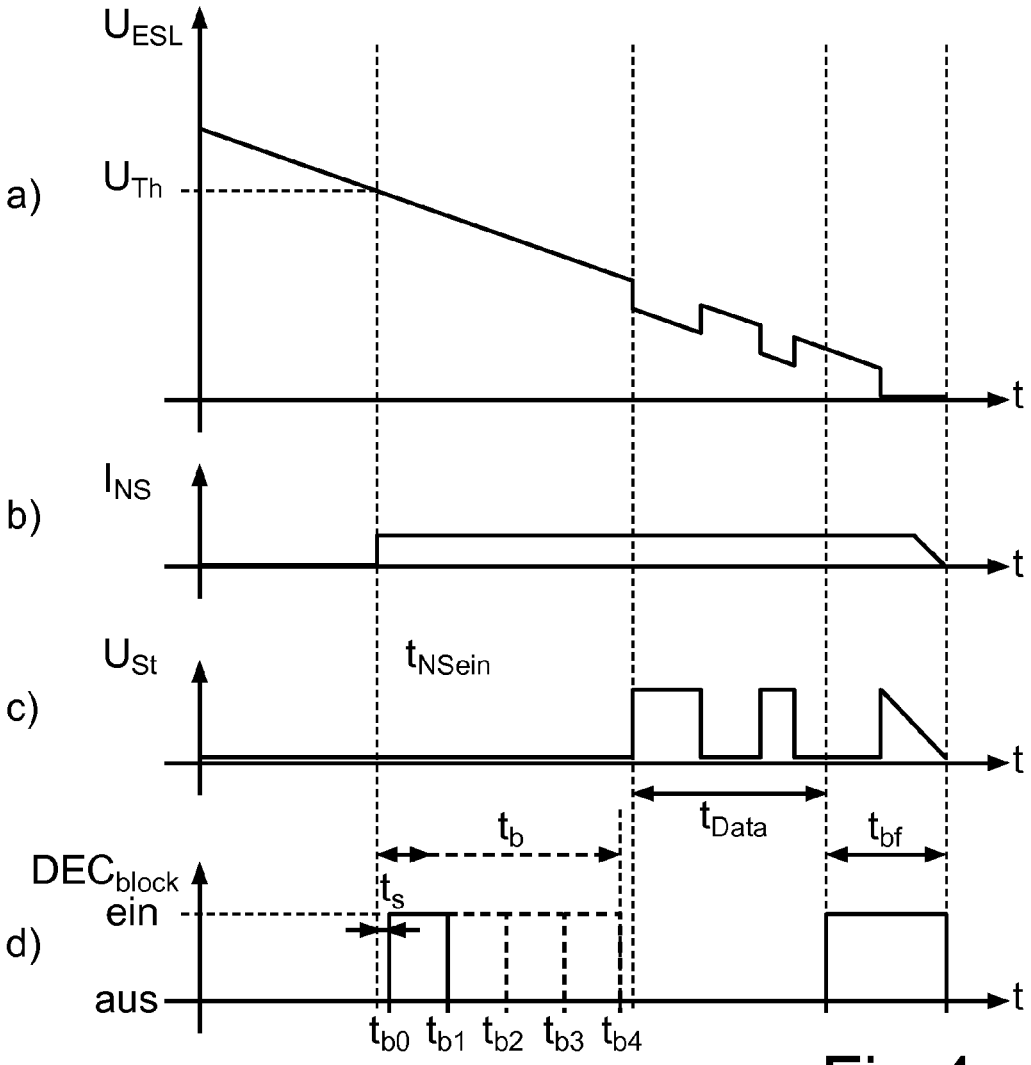
FIGS. 4*a*) to 4*d*) show graphs illustrating the current and voltage profiles at the operating device and the control apparatus for the circuit arrangement illustrated in FIG. 3.

In this context, FIG. 4 shows, in curve a), the time profile of the voltage $U_{ESL}$, which substantially corresponds to the profile in FIG. 2*b*) at the end of the half-cycle, wherein, owing to the enlarged illustration, the sine-wave form appears almost linear. The modulation can again clearly be seen. This can also be identified as voltage $U_{Cont.}$ in curve c) in FIG. 4. This corresponds to the right-hand part of FIG. 2*c*). A different scale has been used for the illustration of curve c) than for the illustration of curve a). The sum of the two voltages $U_{ESL}$ and $U_{Cont.}$ of course gives the system voltage $U_{Sys.}$. The time period for which control information is transmitted is identified by $t_{Data}$.

Curve b) in FIG. 4 shows the activation of the shunt by means of the switch 10 at time $t_{Sh.On}$, i.e. at the time at which the voltage $U_{ESL}$ has fallen below a predeterminable threshold value $U_{Th}$.

After time $t_{Sh.On}$, the decoder 11 would accordingly be reception-ready. Since the control apparatus 1 and the operating device 5 are not synchronized, however, the time at which the transmission of the control information actually begins is not known in the operating device 5. In particular owing to tolerances of the system voltage $U_{Sys.}$, the voltage-controlled time $t_{Sh.On}$ at which the shunt is switched on changes. The time $t_{Sh.On}$ accordingly migrates towards the left in the case of relatively low voltages, i.e. the shunt is switched on for longer in the case of an undervoltage than in the case of an overvoltage. Depending on the system voltage $U_{Sys.}$ actually present at that time, the time period between switch-on of the shunt $t_{Sh.On}$ and the beginning of the actual data transmission varies accordingly.

The operating device 5 itself does not have any time information on the last zero crossing of the system voltage. This is because it is very complicated, in particular in the event of the occurrence of ripple-control signals, to detect the zero crossing of the fundamental of the AC voltage $U_{Sys.}$. Therefore, the decoder 11 preferably transfers to the reception mode as soon as the shunt 9 is switched on.

If an interference signal now occurs prior to the actual data transmission, the operation of the decoder 11 is impaired since it interprets this interference signal as part of the data signal to be decoded.

With reference to FIG. 4, curve d), the following procedure is therefore followed when it has been established that no valid control information has been received during the evaluation of the present half-cycle. The decoder 11 actuates the demodulation activation apparatus 14 and communicates to it that no valid data have been received. Thereupon, the demodulation activation apparatus 14 blocks the decoder 11 during the subsequent half-cycle of the supply voltage $U_{Sys.}$, preferably starting from time $t_{Sh.On}$, the activation of the shunt, for a preferably fixed, predeterminable time $t_b$. Blocking of the decoder 11 can take place, for example, by virtue of the fact that the microcontroller provided in the decoder 11 is instructed by means of software not to evaluate the signal present at its input. Alternatively, the signal to be evaluated can be set to zero during the blocking time period by means of a filter circuit.

In the first step, $t_b$ is equal to $t_{b0}$ to $t_{b1}$; cf. curve d) in FIG. 4. The demodulation activation apparatus 14 applies a corresponding signal $DEC_{block}$ to the decoder 11. Then, a check is performed to ascertain whether valid data are received in the next half-cycle of the supply voltage $U_{Sys.}$. If valid data have been received, the value for the duration $t_b$ is kept constant and, starting from time $t_{Sh.On}$, the decoder 11 is blocked during the time period $t_b$ equal to $t_{b0}$ to $t_{b1}$ in each subsequent half-cycle.

If no valid data have been received, the value for the duration $t_b$ is preferably increased to $t_b$ equal to $t_{b0}$ to $t_{b2}$ (cf. curve d) in FIG. 4), and the decoder 11, starting from time $t_{Sh.On}$ is blocked for the duration $t_b$ equal to $t_{b0}$ to $t_{b2}$ in the subsequent half-cycle of the supply voltage $U_{Sys.}$, in this case once a time period $t_s$ has elapsed. Then a check is performed to ascertain whether valid data have been received in the next half-cycle. If again no valid data have been received, the previously mentioned step of extending the duration $t_b$ is repeated iteratively with increasing time $t_b$ until a predeterminable maximum value $t_{bmax}$ for $t_b$ is reached. In the exemplary embodiment, this duration $t_{bmax}$ is equal to $t_{b0}$ to $t_{b4}$. If no valid data are received even with $t_{bmax}$, the duration $t_b$ is changed again. For this purpose, the duration $t_b$ can be reduced stepwise or linearly, starting from $t_{bmax}$, for example back to $t_b$=$t_{b0}$ to $t_{b1}$. Alternatively, $t_b$ can be reset suddenly to the initial value $t_b$ equal to $t_{b0}$ to $t_{b1}$.

If valid data have been received in a half-cycle, the decoder 11 can be blocked immediately after complete data transmission for the rest of the half-cycle, i.e. for the time period $t_{bf}$ in curve d) in FIG. 4. Alternatively, it can be switched in such a way that fluctuations in the voltage $U_{ESL}$ up to the following zero crossing of the supply voltage $U_{Sys.}$ are ignored.

In the event of the occurrence of a one-off short interference, however, this procedure being implemented may mean that, owing to the extension of the time period $t_b$, the decoder 11 is blocked in the following half-cycle for a time period which falls within the time of the actual data transmission $t_{Data}$. This would mean that subsequent data transmission which is fault-free per se is ignored because the reception of valid data is suppressed. Furthermore, this would mean that the duration $t_b$ is initially extended even further corresponding to the proposed method in order to then be shortened again when $t_{bmax}$ is reached until data are received correctly again. This can mean that the system is not operational for a comparatively long period of time.

In order to prevent this undesired blocking of the decoder 11, the method according to the invention can be developed by the following measure: accordingly, a first-time occurrence of a failed data transmission does not immediately result in extension of the blocking time $t_b$, but rather only a predeterminable number of half-cycles with failed data transmission. In the case of failed data transmission, the transmitted telegram is nevertheless rejected completely, but, by virtue of delayed activation of the decoder blocking, it is possible to prevent the duration $t_b$ during which the decoder 11 is blocked from being increased immediately and therefore the risk of the blocking of the decoder 11 itself preventing the reception of further data, after the occurrence of one-off interference.

In order to implement a delay in the activation of the decoder blocking, an error store can particularly preferably be used, with the number of successive half-cycles with failed data transmission being added in said error store. If a predeterminable maximum value for the count of the error store is reached, the duration $t_b$ is extended.

In order to reduce the number of half-cycles with failed data transmission stored in the error store, for example, the number of half-cycles with successful data transmission can be subtracted until, at a minimum, a count of zero is reached. The maximum value to be exceeded is matched correspondingly.

However, it is also possible to set the error store suddenly to zero after the first fault-free data transmission after failed transmissions.

In the event of the occurrence of one-off interference, excessive extension of the latency of the data transmission can be avoided with this configuration of the method according to the invention.

Further embodiments of the method which are characterized by different ways of iteratively setting the duration $t_b$ are possible. For example, the duration $t_b$ could be established not by multiplying a minimum interval, but by being defined by linear or nonlinear functions.

The temporal position of a first blocking time period can also be varied, as a deviation from the above-described method in which the blocking time preferably begins after the time period $t_s$. In particular, $t_s$ can be zero.

If for technical reasons, for example owing to an excessively low computation power of the processor used, it is not possible to implement the steps of the method on the basis of transmission errors of the half-cycle, it can expediently be applied to entire telegrams as well. In this case, the duration $t_b$ would be varied in each case at the beginning of the transmission of a telegram, and not at the beginning of the respective next half-cycle.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for transmitting control information from a control apparatus to an operating device for at least one light-emitting means, wherein the operating device has a first and a second supply connection, wherein the control apparatus has an input, which is coupled to the phase conductor of an AC voltage system;

wherein the first supply connection is coupled to an output of the control apparatus via a supply line;

wherein the second supply connection is coupled to the neutral conductor of an AC voltage system;

the method comprising:

a) modulating the control information onto the supply line by means of the control apparatus during a modulation phase, wherein, at least during the modulation phase, a switchable shunt of the operating device is connected between the first and second supply connections;

b) decoding the control information in a decoder of the operating device;

b1) activating the demodulation by the decoder when the absolute value for the voltage at the two supply connections falls below a first predeterminable threshold value, wherein the demodulation is blocked for a first predeterminable time period, once a second predeterminable time period has elapsed, once the absolute value for the voltage at the two supply connections has fallen below the first predeterminable threshold value when the decoder has not received any valid control information in the preceding half-cycle of the voltage at the two supply connections; and c) actuating a converter of the operating device in accordance with the decoded control information.

2. The method as claimed in claim 1, wherein the modulation of the control information begins after a predeterminable time period after a last zero crossing of the AC voltage.

3. The method as claimed in claim 1, wherein the voltage at the two supply connections is rectified at least prior to b).

4. The method as claimed in claim 1, further comprising:

b2) if, after b1), valid control information has been received:

retaining the first predeterminable time period;

b3) if, after b1), no valid control information has been received:

extending the first predeterminable time period.

5. The method as claimed in claim 4, further comprising:

b4) if, after b3), valid control information has been received:

retaining the extended first predeterminable time period;

b5) if, after b3), no valid control information has been received:

extending the first predeterminable time period and respectively checking for reception of valid control information;

if valid control information has been received:

retaining the present first predeterminable time period;

if no valid control information has been received:

extending the first predeterminable time period until a predeterminable maximum value for the first predeterminable time period is reached.

6. The method as claimed in claim 5, further comprising:

b6) if still no valid control information is received once the predeterminable maximum value for the first predeterminable time period has been reached:

shortening, in particular stepwise or linearly, the first predeterminable time period and respectively checking for the reception of valid control information; or resetting the first predeterminable time period to the start value for the first predeterminable time period according to b1).

7. The method as claimed in claim 1, further comprising:

b7) if valid control information has been received in a half-cycle, one of:

blocking the demodulation for the rest of the half-cycles; and the decoder ignoring voltage fluctuations at the input of the lamp unit up to the following zero crossing of the voltage between the two supply connections.

8. The method as claimed in claim 1, further comprising:

b8) one of prior to implementing b1) and prior to implementing b3):

counting the successive predeterminable half-cycles in which no valid control information was received;

if the count exceeds a second predeterminable threshold value: implementing b1).

9. The method as claimed in claim 8, wherein, in b8), a count is continuously determined, in which a half-cycle in which valid control information has been received enters with a positive mathematical sign and a half-cycle in which no valid control information has been received enters with a negative mathematical sign;

if the count exceeds a third predeterminable threshold value:

implementing one off b1) and step b3).

10. The method as claimed in claim 1, further comprising:

the second predeterminable time period is between 0 and 8 times the first predeterminable time period.

11. The method as claimed in claim 1, wherein the control information comprises a multiplicity of half-cycles, wherein each half-cycle of the multiplicity of half-cycles is evaluated in accordance with b1).

12. An operating device for operating at least one light-emitting means, the operating device comprising:

a first and a second supply connection for coupling to an AC voltage source;

at least one connection for coupling to the at least one light-emitting means;

a converter, which is designed in such a way that it converts electrical energy which is provided at the supply connections into a form which is suitable for the light-emitting means and feeds this to the light-emitting means;

a decoder for decoding a modulation, which is applied by a control apparatus to the AC voltage between the two supply connections, wherein the decoder is designed to provide control information depending on the modulation for actuating the converter;

a shunt, which can be switched between the first and second supply connections and is conducting at least as long as the voltage at the supply connections has been modulated by the control apparatus;

wherein the operating device furthermore comprises a demodulation activation apparatus, which is coupled to the decoder, wherein the demodulation activation apparatus is designed to activate the decoder for demodulation of the voltage at the two supply connections when the absolute value of the voltage at the supply connections falls below a first predeterminable threshold value, wherein the demodulation activation apparatus is furthermore designed to block a demodulation for a first predeterminable time period, once a second predeterminable time period has elapsed, once the absolute value for the voltage at the supply connections has fallen below the first predeterminable threshold value when the decoder has not received any valid control information in the preceding half-cycle of the voltage at the two supply connections.

13. The method as claimed in claim 3, wherein the voltage at the two supply connections is rectified at least prior to a comparison with the first predeterminable threshold value.

14. The method as claimed in claim 4, wherein the first predeterminable time period is extending by a predeterminable duration or in accordance with one of a linear and a nonlinear function.

15. The method as claimed in claim 5, wherein the first predeterminable time period is extending by the predeterminable duration.

16. The method as claimed in claim 6, wherein the shortening is carried out one of stepwise and linearly.

* * * * *